US005151691A

United States Patent [19]

Kuijk

[11] Patent Number: 5,151,691

[45] Date of Patent: Sep. 29, 1992

[54] ACTIVE DISPLAY DEVICE

[75] Inventor: Karel E. Kuijk, Eindhoven, Netherlands

[73] Assignee: U.S. Philips Corporation, New York, N.Y.

[21] Appl. No.: 606,013

[22] Filed: Oct. 30, 1990

[30] Foreign Application Priority Data

Nov. 27, 1989 [NL] Netherlands ..... 8902922

[51] Int. Cl.[5] ..... G09G 3/36

[52] U.S. Cl. ..... 340/784; 340/719; 359/60

[58] Field of Search ..... 340/784, 719, 765, 775, 340/752, 805, 718, 785, 787; 350/332, 333, 334; 358/236, 241; 359/57, 58, 59, 60

[56] References Cited

U.S. PATENT DOCUMENTS

| | | | |
|---|---|---|---|
| 3,532,813 | 10/1970 | Lechner | 340/784 |
| 3,654,606 | 4/1972 | Marlowe et al. | 359/60 |
| 4,525,709 | 6/1985 | Hareng et al. | 340/784 |
| 4,636,788 | 1/1987 | Hilbrink | 340/718 |
| 4,641,135 | 2/1987 | Hilbrink | 340/784 |
| 4,680,580 | 7/1987 | Kawahara | 340/719 |
| 4,731,610 | 3/1988 | Baron et al. | 340/784 |
| 4,794,385 | 12/1988 | Kuijk | 340/784 |
| 4,811,006 | 3/1989 | Kuijk | 340/719 |
| 4,958,152 | 9/1990 | Kuijk et al. | 340/719 |
| 4,994,796 | 2/1991 | Kuijk | 340/719 |
| 5,032,830 | 7/1991 | Kuijk | 340/784 |
| 5,032,831 | 7/1991 | Kuijk | 340/805 |

*Primary Examiner*—Alvin E. Oberley
*Assistant Examiner*—Xiao Wu
*Attorney, Agent, or Firm*—Robert J. Kraus

[57] ABSTRACT

In a display device driven with an active matrix the capacitances associated with the pixels (2) are first discharged or charged as far as or beyond the range of transition in the transmission/voltage characteristic before they are accurately adjusted. A capacitive element (10) is connected in parallel with a series arrangement of first (5) and second (8) asymmetrical non-linear switching elements and stores an electric charge which is used for discharging or charging the pixels.

23 Claims, 4 Drawing Sheets

ACTIVE DISPLAY DEVICE

BACKGROUND OF THE INVENTION

This invention relates to a display device comprising an electro-optical display medium positioned between two supporting plates, a system of pixels arranged in rows and columns, with each pixel being defined by two picture electrodes arranged on the facing surfaces of the supporting plates, a system of row and column electrodes for driving the pixels, at least one first asymmetrical non-linear switching element being arranged in series with each pixel between the pixel and a row electrode.

A display device of this type is suitable for displaying alphanumerical information and video information by means of passive electro-optical display media such as liquid crystals, electrophoretic suspensions and electrochromic materials.

A display device of the type described in the opening paragraph is known from Netherlands Patent Application no. 8701420 (PHN 12.154), which corresponds to U.S. Pat. No. 5,032,831 (July 1991). In a display device shown in this Application the pixels are given a certain adjustment for each row in that the capacitances associated with these pixels are accurately charged or discharged after they have first been discharged or charged too far (whether or not accurately). To this end such a picture display device is provided with means for applying, prior to selection, an auxiliary voltage across the pixels beyond or on the limit of the voltage range to be used for picture display.

In one of the embodiments this is effected by means of diodes which are connected to a suitably chosen reference voltage. A drawback of such a display device is that voltage lines must be provided between the pixels in the column direction for the reference voltage. Usually one or two column electrode(s) are alternately provided between the columns of pixels, namely one electrode for the reference voltage, two column electrodes, and so forth. Such a division is not only at the expense of the effective picture surface area, but also gives rise to artifacts in the picture.

A second drawback is that the picture electrodes, the column electrodes and the switching elements are realised on one and the same supporting plate, while the column electrodes, as well as the electrodes for the reference voltage, may be implemented as metal lines. The row electrodes are then provided on the other supporting plate and simultaneously constitute the counter electrodes of the picture electrodes. Therefore, these row electrodes are implemented as light-transmissive electrodes of, for example, indium tin oxide (having a width which is equal to the height of the picture electrodes). Such indium tin oxide electrodes usually have a high resistance so that accurate charging during one line period is not always possible.

Moreover, a so-called delta-colour filter configuration cannot be used without special measures in such a display device.

It is one of the objects of the present invention to provide a display device of the type described in the opening paragraph, which device has a large effective surface area and in which delta-colour filter configurations are readily applicable.

It is a further object of the invention to provide a display device in which an accurate adjustment of the pixels is possible.

SUMMARY OF THE INVENTION

The invention is based, inter alia, on the recognition that the pixels can be discharged or charged as far as beyond the range to be used for picture display by making use of a charge which has been stored.

A display device according to the invention is characterized in that the display device comprises, at the location of a pixel, at least one second asymmetrical non-linear switching element arranged in series with the first asymmetrical non-linear switching element between the pixel and a node and in that the display device comprises, at the location of a pixel, at least one capacitive element arranged parallel to the series arrangement of the first and second non-linear switching elements.

The capacitive element functions, as it were, as a charge reservoir (positive or negative charge) by means of which the pixel can be charged or discharged as far as or beyond the voltage transmission range. This charging or discharging is no longer effected via a reference electrode on the same supporting plate and arranged in the same direction as the column electrodes, but via a reference electrode arranged in the row direction. The electrodes in the row direction (row and reference electrodes) can now be implemented as low-ohmic metal strips, thus precluding a number of said drawbacks (high row resistances, problems in using delta-colour filter configuration).

At least a part of a row electrode preferably constitutes a first electrode of the capacitive element.

In a first preferred embodiment of a display device according to the invention, the nodes of pixels associated with a row are interconnected to form a common electrode which is connected to an external connection via at least a third non-linear switching element. The level of the charge in the charge reservoir is maintained via this connection.

The third non-linear switching element may be present within or outside the actual display device.

The common electrode preferably constitutes a second electrode of the capacitive element.

This provides the possibility of implementing the capacitive elements associated with a row of pixels as two substantially superjacent metal lines with a layer of dielectric material being interposed. In this case the drawback of the occurrence of artifacts in the picture is also obviated.

In a second preferred embodiment of a display device according to the invention a non-linear resistance element is arranged parallel to the capacitive element. The capacitive element and the non-linear resistance element may be realised as a metal-isolator-metal element. The leakage current through the non-linear resistance element now ensures the supply to the charge reservoir.

A first electrode of such a metal-isolator-metal element may form a part of a row electrode.

In this case it is possible to implement the metal-isolator-metal elements associated with a row of pixels as a row electrode and a substantially subjacent or superjacent row of metal strips with a layer of dielectric material being interposed.

For example, tantalum is chosen for the lower metal layer or strip and tantalum oxide is chosen for the layer of dielectric material. The latter may be deposited by means of electro-deposition. On the other hand, for example, chromium or aluminium may be chosen for the metal layer or strip while silicon nitride or oxynitride (provided by way of sputtering or evaporation techniques) is chosen as a dielectric material.

For the non-linear switching elements diodes are preferably chosen such as, for example, a pn diode, Schottky diode, pin diode, but also other asymmetrical non-linear switching elements are possible such as, for example, a transistor having a short-circuited base collector, implemented in monocrystalline, polycrystalline or amorphous silicon, CdSe or another semiconductor material, while the diodes may be implemented both vertically and laterally.

For reasons of redundancy, an asymmetrical non-linear switching element may alternatively be built up from a plurality of sub-elements.

To charge or discharge all pixels in a uniform way, it may be advantageous to keep the column voltages equal to zero volt during the reset voltage. Moreover, the reset voltage may then be lower.

BRIEF DESCRIPTION OF THE DRAWINGS

The invention will now be described in greater detail by way of example with reference to some embodiments shown in the accompanying drawings, in which:

FIG. 4 shows diagrammatically a modification of the display device of FIG. 1, while

DETAILED DESCRIPTION OF A PREFERRED EMBODIMENT OF THE INVENTION

Figure 1:
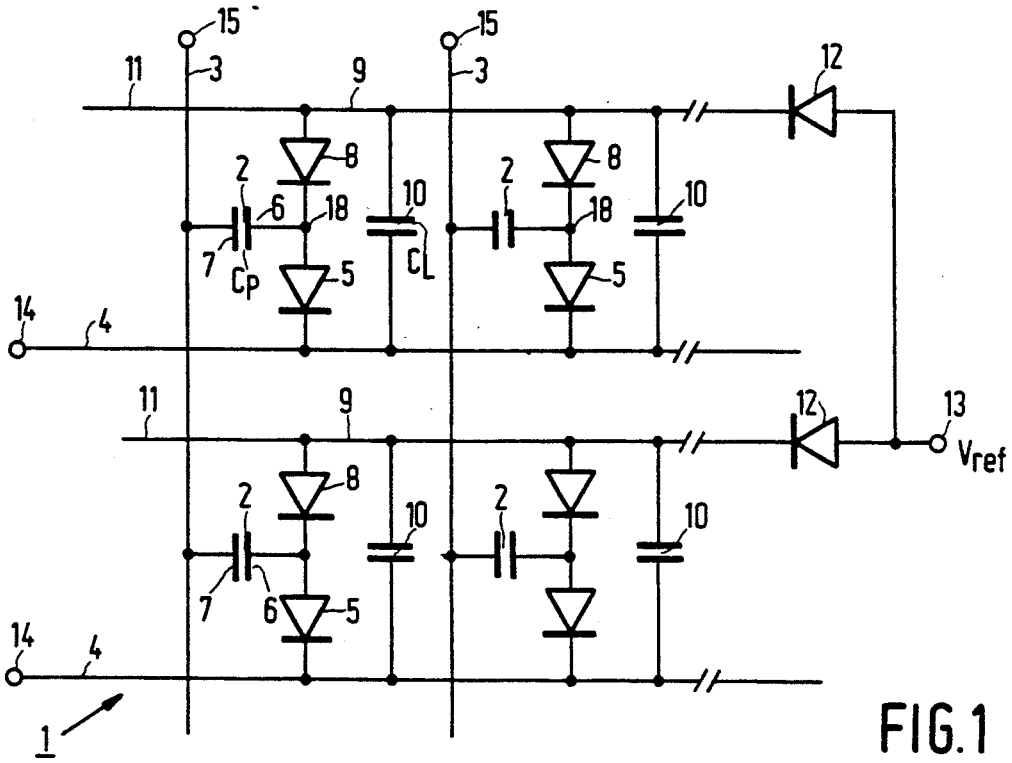
FIG. 1 shows diagrammatically a part of a display device according to the invention.

FIG. 1 is a diagrammatic representation of a part of a display device 1 according to the invention, for example, a liquid crystal display device. The pixels 2 arranged in rows and columns are located at the area of crossings of a system of column electrodes 3 and row electrodes 4. Asymmetrical non-linear switching elements, in this example diodes 5, are arranged between the picture electrodes 2 and the row electrodes 4. Each diode 5 is connected to a picture electrode 6 of a pixel 2. The other picture electrode 7 is connected to a column electrode 3 (see FIG. 1).

The display device of FIG. 1 also comprises a second diode 8 arranged in series with the first diode 6, while a capacitive element 10 is arranged parallel to the series arrangement of the two diodes 5, 8 between the row electrode 4 and a node 9 which is common to the diode 8 and the capacitive element 10. In the present example the nodes 9 are interconnected by means of a row electrode 11 which is connected via a diode 12 (or another asymmetrical non-linear switching element) to a terminal 13 for a reference voltage $V_{ref}$. In this example the row and column electrodes are provided with terminals 14 and 15, respectively. As will be described hereinafter, the display device shown can be driven by means of a similar drive mode as described in the U.S. patent referred to above.

Figure 2:
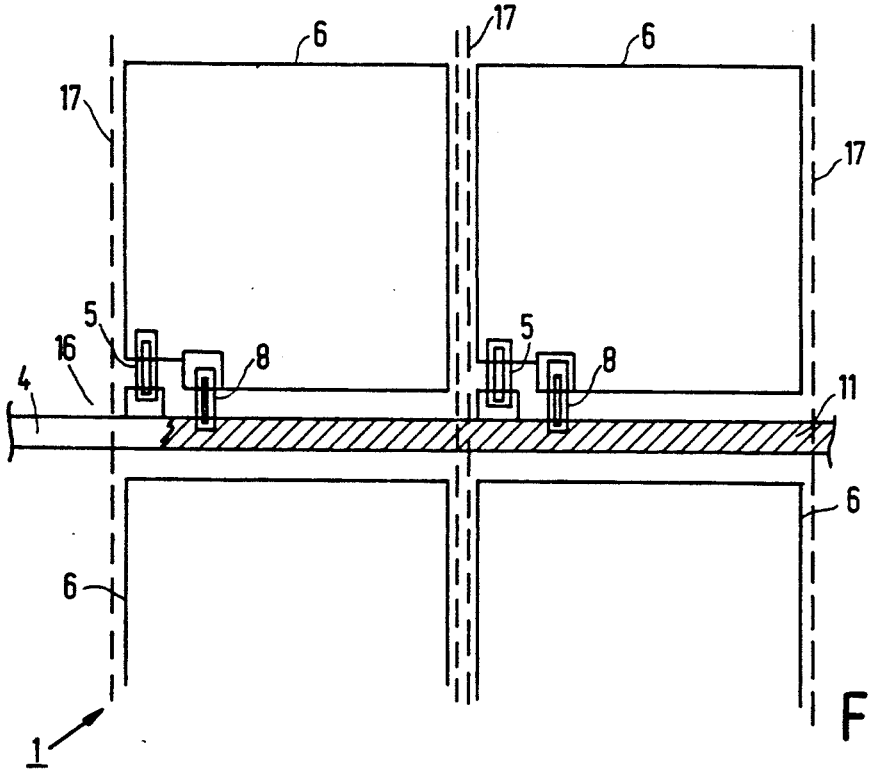
FIG. 2 is a diagrammatic plan view of a part of the display device of FIG. 1, FIGS. *3a–3c* show some drive voltages and internal voltages in the display device of FIG. 1.

FIG. 2 is a diagrammatic plan view of a part of the display device 1 of FIG. 1. A matrix of picture electrodes 6 at the location of the pixels is provided on a first supporting plate 16. The picture electrodes 6 are connected via diodes 5 and 8, shown diagrammatically, to a row electrode 4 and a superjacent electrode 11, respectively. In this example the row electrode 4 is made of tantalum on which a layer of tantalum oxide is deposited by anodic oxidation before the layer 11 of, for example, aluminium is deposited thereon. The tantalum-tantalum oxide-aluminium structure constitutes a (divided) capacitance throughout the length of the structure between the lines 4 and 11, which capacitance is the physical realisation of the capacitive elements 10 of FIG. 1.

The picture electrodes 7 of, for example, indium tin oxide are arranged on the other supporting plate and in this example they coincide with the column electrodes. In FIG. 2 these are shown by means of broken lines 17.

After the supporting plates thus formed have been provided, if necessary with a protective coating and/or a layer of orienting material, the display device is completed in a generally known manner by providing spacers, by sealing and filling, whereafter the assembly is provided, if necessary with polarisers, reflectors, etc.

The device of FIGS. 1, 2 comprises two metal conductors per row of pixels in the row direction. However, the metal conductors are arranged one above the other, thus increasing the effective surface area of the pixels with respect to the device according to U.S. Pat. No. 5,032,831 in which alternately two metal strips and one metal strip are located between columns of pixels. This also reduces the occurrence of artifacts. Since the row electrodes are now in the form of metal tracks, the pixels have a shorter charge time so that a more accurate adjustment is possible. Moreover, a wider choice of colour filters (for example so-called delta structures) is realised.

Other asymmetrical non-linear switching elements may alternatively be chosen for the diodes 5, 8, 12, such as, for example pin diodes, Schottky diodes or a series or parallel arrangement of a plurality of diodes for the purpose of redundancy. The use of a series arrangement may be notably favourable if the asymmetrical non-linear switching element must be able to withstand a large voltage range.

The device shown is very suitable for using a drive method in which $$V_C = \frac{V_{sat} + V_{th}}{2}$$

is chosen for the average voltage across a pixel (with $V_{th}$ being the threshold voltage and $V_{sat}$ being the saturation voltage of the electro-optical element) so that the absolute value of the voltage for picture display across the pixels 12 is substantially limited to the range between $V_{th}$ and $V_{sat}$.

A satisfactory operation as far as grey scales are concerned is obtained if, dependent on the data voltages $V_d$ on the column electrodes 3, the voltage values across the pixels 2 are $V_c+V_{dmax}=V_{sat}$ at a maximum and $V_c-V_{dmax}=V_{th}$ at a minimum. Elimination of $V_c$ yields: $|V_d|_{max}=\frac{1}{2}(V_{sat}-V_{th})$, i.e. $-\frac{1}{2}(V_{sat}-V_{th})\leqq V_{d\text{-}max}\leqq\frac{1}{2}(V_{sat}-V_{th})$.

To charge a row of pixels 2, for example positively, the associated row electrode 4 is supplied with a selection voltage $V_s=-V_{on1}-\frac{1}{2}(V_{sat}+V_{th})$ in which $V_{on1}$ is the forward voltage of the diode 5. The voltage across the pixels 2 is therefore $V_d - V_{on1} - V_s$; it ranges between $-\frac{1}{2}(V_{sat}-V_{th})+\frac{1}{2}(V_{sat}+V_{th})=V_{th}$ and $\frac{1}{2}(V_{sat}-V_{th})+\frac{1}{2}(V_{sat}+V_{th})=V_{sat}$, dependent on $V_d$.

In the case of non-selection the requirement must be satisfied that neither diodes 5 nor diodes 8 can conduct, in other words, it must hold for the voltage $V_A$ at the node 18 that $V_A \leqq V_{ns1}$ (1) and $V_A \geqq V_{line}$ (2) in which $V_{ns1}$ is a non-selection voltage and $V_{line}$ is the voltage at line 11, or $$V_{Amax} \leqq V_{ns1} \quad (1)$$

and $$V_{Amin} \geqq V_{line} = V_{ns1} - V_{cli} \quad (2)$$

in which $V_{cli}$ is the minimum required voltage across the capacitive element 10 at which it continues to function as a charge reservoir.

It follows from (1) that:

$$V_{ns1} \geqq V_{Amax} = \tfrac{1}{2}(V_{sat}-V_{th}) - V_{th} \quad (3)$$

and it follows from (2) that $$V_{ns1} - V_{cli} \leqq V_{Amin} = -\tfrac{1}{2}(V_{sat}-V_{th}) - V_{sat} \quad (4)$$

It follows for $V_{cli}$ that:

$$V_{cli} \geqq V_{ns1} + \tfrac{1}{2}(V_{sat}-V_{th}) + V_{sat} = 2(V_{sat}-V_{th}) \quad (5)$$

In order to negatively charge the same row of pixels 2 (in a subsequent frame or field period) at a subsequent selection with inverted data voltages, these pixels are first negatively charged too far by means of a reset voltage $V_{reset}$ at the row electrode 11. Subsequently the selected row electrode (in the same line period or in a subsequent period) receives a selection voltage $V_{s2} = -V_{on1} + \frac{1}{2}(V_{sat}+V_{th})$. The pixels 2 which are negatively charged too far are now charged via the diodes 5 to $V_d - V_{on1} - V_{s2}$, i.e. to values between $-\frac{1}{2}(V_{sat}-V_{th}) - \frac{1}{2}(V_{sat}+V_{th}) = -V_{sat}$ and $\frac{1}{2}(V_{sat}-V_{th}) - \frac{1}{2}(V_{sat}+V_{th}) = -V_{th}$ so that information having an opposite sign is presented across the pixels 2.

When negatively charging too far in advance, it must be taken into account that the capacitive element may have lost a part of its charge having a quantity of $\Delta V_{Cl}$. The quantity $\Delta V_{Cl}$ is maximum when the pixel 2 (and hence the capacitance Cp) is charged from $V_{sat}$ to $-V_{sat}$. The capacitance Cl is then discharged by a quantity of $$\Delta V_{Cl} = 2V_{sat}\frac{C_p}{Cl} \quad (6)$$

To keep $\Delta V_{Cl}$ small, it is preferred to choose the ratio $Cl/Cp >> 1$, for example 5 to 10. To this end (see FIG. 2) the metal lines 4, 11 can be arranged one over the other with a dielectric as an intermediate layer so that a capacitance is formed which has the value Cl for each width of one pixel (defined by the picture electrode 6 in FIG. 2). For example, the lower line 4 is made of tantalum which is anodised so that a dielectric of tantalum oxide is produced which is free from pin holes and has a high dielectric constant ($\epsilon_r \simeq 24$). With a width of the metal lines of 1/15 of the height of one pixel, it holds for a liquid crystal mixture ZLI 84460 of the firm of Merck ($\epsilon_r \simeq 6$) and thicknesses of the pixel and the tantalum oxide of 4.5 μm and 0.12 μm for Cl/Cp, respectively, that:

$$Cl/Cp \simeq \frac{1}{15}\cdot\frac{24}{6}\cdot\frac{4.5}{12} \simeq 10.$$

Further, $V_{sat} \simeq 3.5$ V so that with (6) $\Delta V_{Cl} \simeq 0.7$ V. As stated hereinbefore, this must be taken into account when charging negatively too far in advance. For the reset voltage used for this purpose it therefore holds in the worst case, namely if the highest voltage ($V_d = \frac{1}{2}(V_{sat}-V_{th})$) is present at a column electrode 3:

$$V_{reset} \geqq V_{Amax} + V_{on2} + V_{Cli} + \Delta V_{Cl}$$

or $$V_{reset} \geqq \tfrac{1}{2}(V_{sat}-V_{th}) + V_{sat} + V_{on2} + 2(-V_{sat}-V_{th}) + \Delta V_{Cl} \quad (7)$$

where $V_{on2}$ is the voltage across the diode 8 at the end of a reset period.

After negatively charging too far and subsequent accurate negative adjustment of the pixels 2 a non-selection voltage $V_{ns2}$ is applied again to the row electrodes 4. It holds again that $$V_{Amax} \leqq V_{ns2} \quad (8)$$

while $$V_{Amin} \geqq V_{line} \quad (9)$$

or $$V_{ns2} \geqq V_{Amax} = \tfrac{1}{2}(V_{sat}-V_{th}) + V_{sat} \quad \text{(10) (negative selection)}$$

and $$V_{ns2} - V_{Cl} \leqq V_{Amin} = -\tfrac{1}{2}(V_{sat}-V_{th}) - V_{th} \quad (11)$$

in which $$V_{Cl} = V_{Cli} + \Delta V_{Cl}.$$

Combination of (10) and (11) yields $$V_{Cl} \leqq V_{ns2} + \tfrac{1}{2}(V_{sat}-V_{th}) - V_{th} = 2(V_{sat}-V_{th}) \quad (12)$$

At the next selection pulse having a value of $V_{s1}$ the pixel 2 is again charged positively, and simultaneously the capacitive element 10 ($C_l$) is charged in a positive sense via a third diode 12. For the reference voltage $V_{ref}$ to be connected to point 13 it then holds that $$V_{ref} - V_{s1} + V_{Cli} \geqq V_{on3}$$

or $$V_{ref} = V_{s1} + V_{Cli} + V_{on3} \quad (13)$$

in which $V_{on3}$ is the voltage drop across the diode 12 at the end of the selection time $t_{s1}$. With $V_{Cli} = 2(-V_{sat}-V_{th})$ this will be $$V_{ref} = -\tfrac{1}{2}(V_{sat}+V_{th}) - V_{on1} - 2(V_{sat}-V_{th}) + V_{on3} \quad (13')$$

Figures 3A, 3B, 3C:
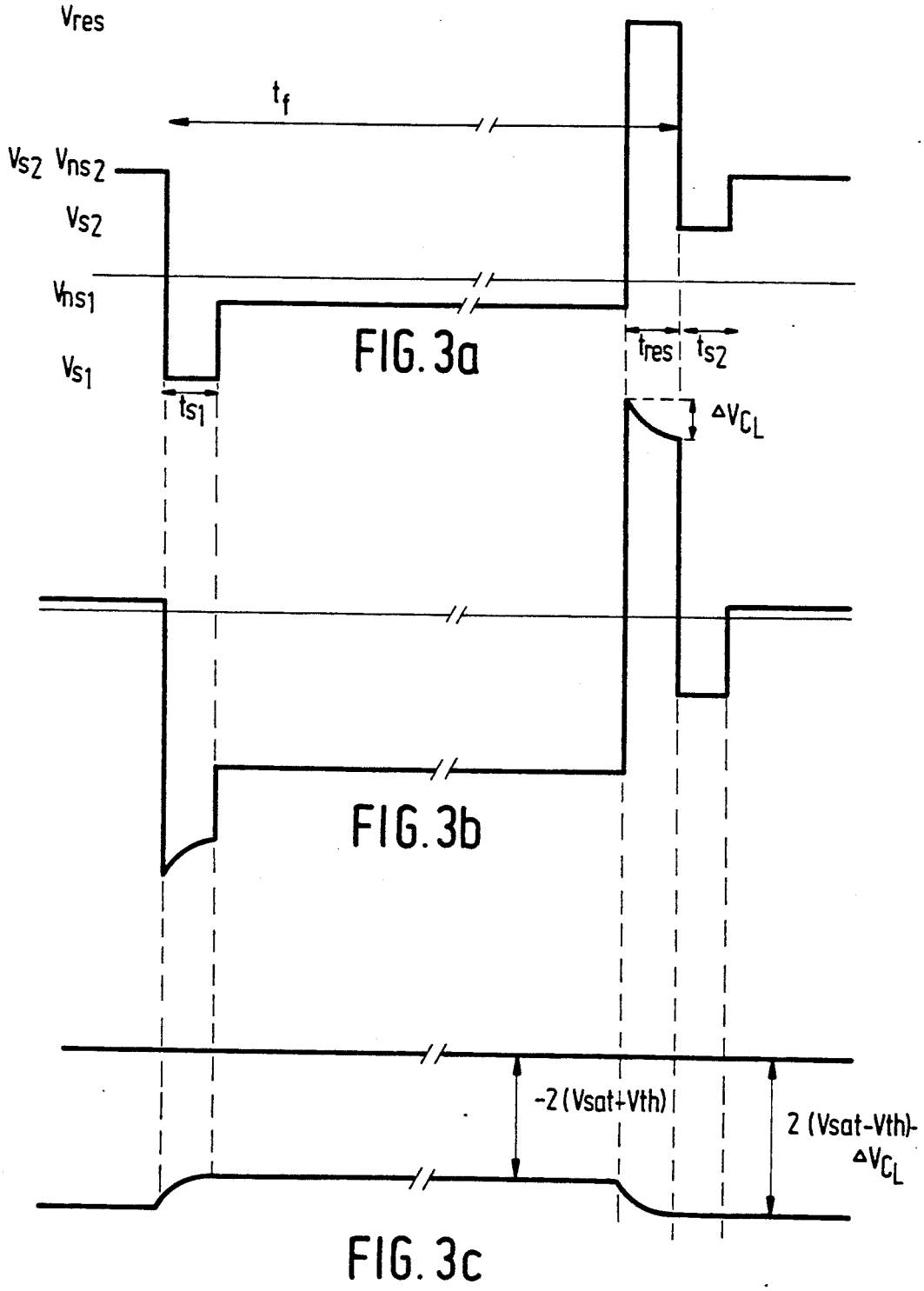

The drive signals on a row electrode 4 for a row of pixels is shown in FIG. 3*a*, while FIG. 3*b* shows the associated voltages on the line 11 and FIG. 3*c* shows the voltage across the capacitive element. In the balanced situation (shown) the reservoir filled by the capacitive element 10 is sufficiently charged positively (to a value of $-2(V_{sat}-V_{th})$) so that the loss of charge due to capacitive couplings is compensated again during the reset pulse.

When a display device according to FIGS. 1, 2 is switched on, the voltage across the capacitive element 10 ($C_l$) is zero Volt. At each reset pulse for the row 4 (dependent on its use, 25, 30, 50 or 60 times per second) $C_l$ is charged slightly more negative in voltage until the diode 12 starts to conduct during a selection pulse and $C_l$ charges slightly positively. This results in the situation of FIGS. 3*a*–3*c*.

For the cut-off voltage across the diode 12 it holds that it can reach a high value, namely:

$$V_{cut\text{-}off} \leqq \tfrac{1}{2}(V_{sat}-V_{th})+V_{sat}+V_{on2}-V_{ref} \quad (14)$$

It is therefore recommended to use a plurality of diodes in series instead of one diode 12 so that the cut-off voltage for each diode is lower. This also ensures redundancy, which is desirable because a diode 12 must supply the current for an entire row (n pixels) during a reset, hence approximately n times as much as a diode 5. For the same desired current density this diode is also approximately n times as large as a diode 5. The diode 12 may also be common to a plurality of lines 11.

Figure 4:
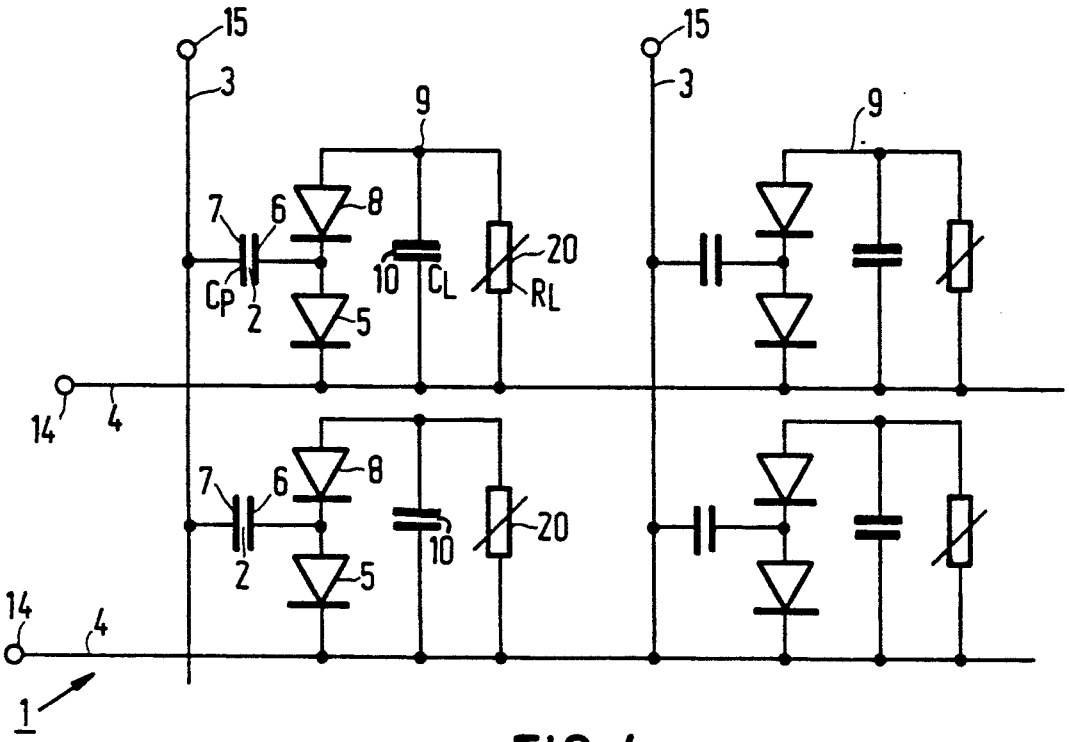
Figure 5:
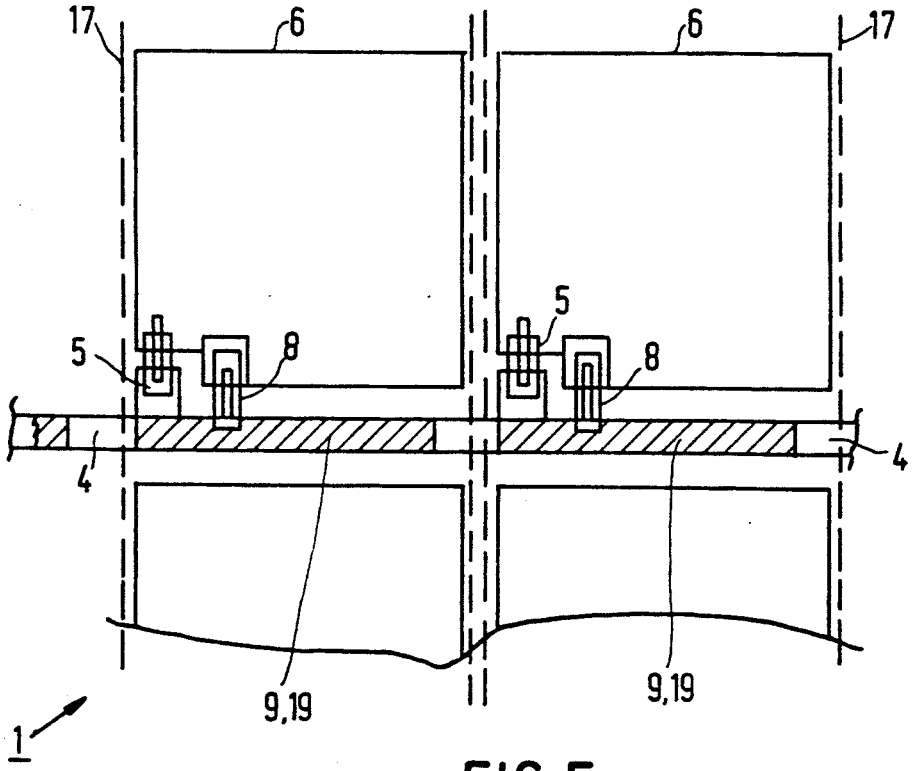
FIG. 5 is a diagrammatic plan view of a part of the display device of FIG. 4, and FIGS. *6a–6c* show some voltages associated with the display device of FIG. 5.

FIGS. 4 and 5 show modifications of the display device of FIGS. 1 and 2. The lines 11 in FIG. 2 are periodically interrupted and constitute metal strips 19 which correspond to the nodes 9 of FIG. 4. Simultaneously, the metal strips 19 constitute the electrodes of a metal-isolator-metal structure comprising an electrode 4 of, for example tantalum, an interposed dielectric of tantalum oxide and the electrode 19. The MIM element implemented in this way is shown in FIG. 4 by the combination of the capacitive element 10 and the non-linear resistor 20. Otherwise, the reference numerals have the same significance as those in FIGS. 1, 2.

Charging the capacitive element in a positive sense, if it is negatively charged too far due to reset pulses, is now effected via the variable resistor 20 of the MIM. It is dimensioned in such a way that at a voltage value $$V_{Cl} \geqq 2(V_{sat}-V_{th})$$

across the capacitive element 10 ($C_l$), the leakage through the nonlinear resistor 20 is substantially negligible so that it holds for the discharge $\Delta V_{Cl2}$ in the period between two reset pulses (for example 30 msec) that:

$$\Delta V_{Cl2} << V_{Cl} \quad (15)$$

Also in this case the voltage across Cl becomes slightly more negative at each reset pulse upon switch-on (with a maximum value per reset pulse of $\Delta V_{Cl1}=Cp/Cl.2V_{sat}$, cf. (6)). This continues until this negative charging is compensated by the leakage current in the non-linear resistor 20 in the period between two reset pulses. A stable state is then reached, at which $$\Delta V_{Cl1}=\Delta V_{Cl2} \quad (16).$$

Figures 6A, 6B, 6C:
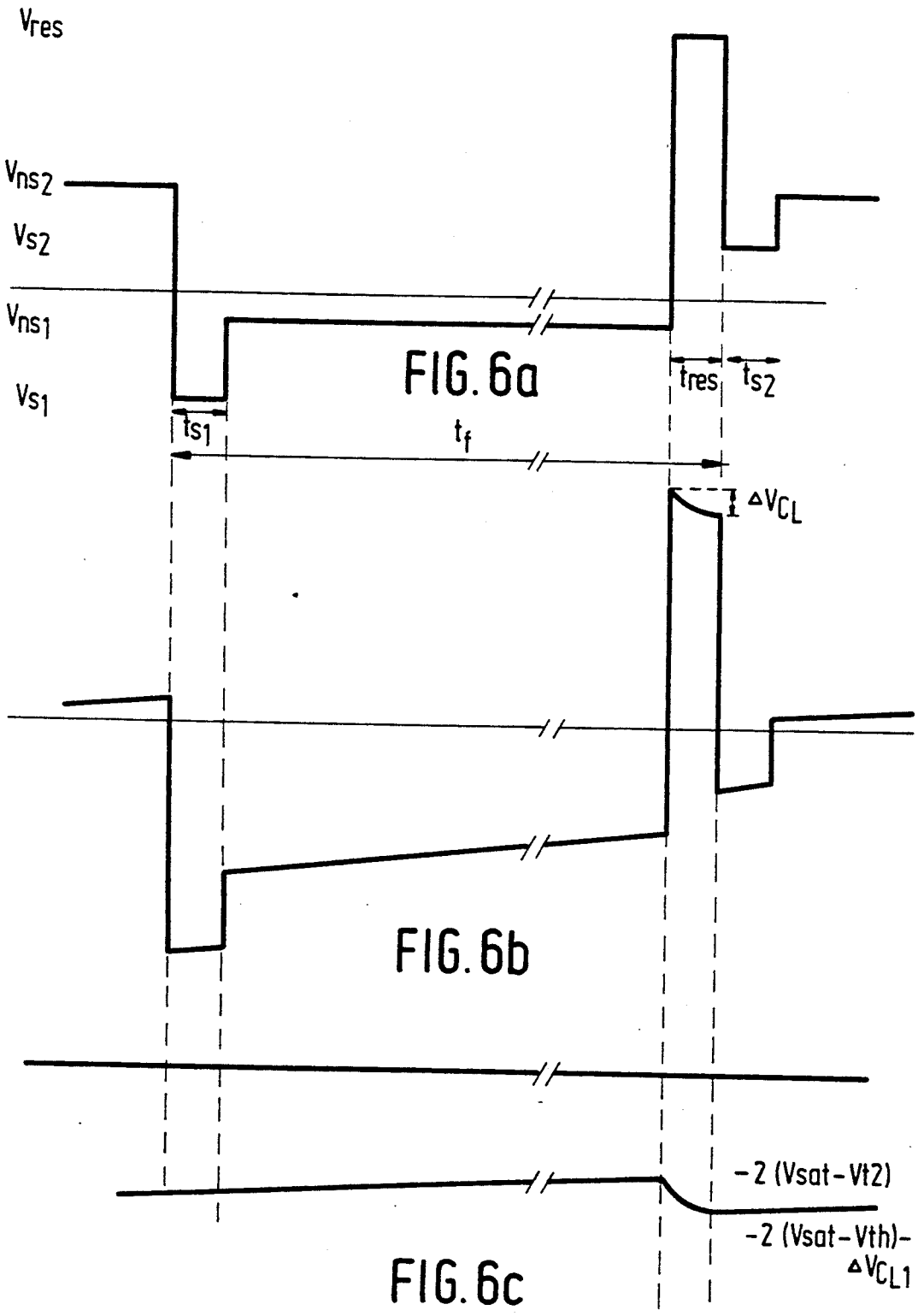

FIG. 6*a* shows the drive voltages on the row electrode 4 in a corresponding manner. The same values can be calculated for these voltages in a manner similar to that described above.

FIGS. 6*b*, 6*c* show, analogously as FIGS. 3*b*, 3*c*, the voltages at the nodes 9 and those across the capacitive elements 10 ($C_l$). Due to the (small) leakage current these voltages are not substantially constant during non-selection, as in the device of FIGS. 1, 2.

As compared with the device of FIGS. 1, 2, the device of FIGS. 4, 5 has the advantage that a possible short circuit between the row electrode 4 and a metallisation strip 19 causes only the associated pixel to drop out, whereas in the case of a short circuit between the row electrode 4 and the line 11 in FIGS. 1, 2 the entire row of associated pixels 2 drops out.

As compared with other display devices, in which a MIM is used as a non-linear switching element, the device has the additional advantage that due to the desired small leakage current the metal-isolator-metal structure has a much thicker dielectric (comparable with the $Ta_2O_5$ layer in FIG. 2) and a larger surface area. As a result the risk of damage due to static electricity or high drive voltages is much smaller. The peak current is also much smaller because the current with which the capacitance Cp associated with the pixel 10 is charged during the reset pulse does not flow through $R_l$ but is supplied from $C_l$. This results in a considerable extension of the lifetime.

The invention is of course not limited to the examples described hereinbefore, but several variations are possible within the scope of the invention. For example, the diodes 5, 8, 12 can be given a reverse sign while simultaneously changing the values for the drive voltages.

The row electrode 4 may alternatively be arranged above instead of below the line 11 and the metallisation strips 15, respectively. The diodes or other non-linear asymmetrical switching elements can be formed to be redundant, for example by using series and/or parallel diode circuits as described in Netherlands Patent Application no. 8800204, which corresponds to U.S. Pat. No. 4,994,796 (Feb. 19, 1991).

It may be advantageous to maintain the column voltages at zero value during the reset pulse so that the reset voltage can be lower, namely $V_{sat}+V_{on2}+2(-V_{sat}-V_{th})+\Delta V_{Cl}$. All pixels in a row are each time charged to one and the same negative voltage in this case. The duration of the reset pulse is also dependent on the selection time $t_s$, dependent on the use.

I claim:

1. A display device comprising: an electro-optical display medium between two supporting plates, a system of pixels arranged in rows and columns, with each pixel being defined by two picture electrodes arranged on the facing surfaces of the supporting plates, a system of row and column electrodes for driving the pixels, at least one first asymmetrical non-linear switching element connected in series with each pixel between the pixel and a row electrode, wherein, at the location of a pixel, at least one second asymmetrical non-linear switching element is connected in series arrangement with the first asymmetrical non-linear switching element and between the pixel and a node and, at the location of a pixel, at least one capacitive element is connected parallel to the series arrangement of the first and second non-linear switching elements.

2. A display device as claimed in claim 1, wherein at least a part of a row electrode constitutes a first electrode of the capacitive element.

3. A display device as claimed in claim 1, wherein, the nodes of pixels associated with a row are interconnected to form a common electrode which is connected to an external connection via at least a third non-linear switching element.

4. A display device as claimed in claim 3, wherein the common electrode constitutes an electrode of the capacitive element.

5. A display device as claimed in claim 4, wherein the capacitive elements associated with a row of pixels comprise two substantially superjacent metal lines with a layer of dielectric material being interposed.

6. A display device as claimed in claim 1, wherein a non-linear resistance element is connected parallel to the capacitive element.

7. A display device as claimed in claim 6, wherein the capacitive element and the non-linear resistance element comprise a metal-isolator-metal element.

8. A display device as claimed in claim 7, wherein a first electrode of the metal-isolator-metal element forms a part of a row electrode.

9. A display device as claimed in claim 8, wherein the metal-isolator-metal elements associated with a row of pixels comprise a row electrode and a substantially superjacent or subjacent row of metal strips with a layer of dielectric material being interposed.

10. A display device as claimed in claim 1, wherein at least one of the non-linear asymmetrical switching elements is formed to be redundant.

11. A display device as claimed in claim 1, wherein the electro-optical medium is liquid crystalline and said first and second asymmetrical non-linear switching elements comprise first and second diodes connected in series aiding configuration.

12. A display device as claimed in claim 1, wherein the display device comprises means for maintaining the column voltages equal to zero volt while a reset voltage is applied to a row electrode.

13. A display device as claimed in claim 2, wherein the nodes of pixels associated with a row are interconnected to form a common electrode which is connected to an external connection via at least a third non-linear switching element.

14. A display device as claimed in claim 13, wherein the common electrode constitutes a second electrode of the capacitive element.

15. A display device as claimed in claim 14, wherein the capacitive elements associated with a row of pixels comprise two substantially superjacent metal lines with a layer of dielectric material being interposed.

16. A display device as claimed in claim 6, wherein at least one of the non-linear asymmetrical switching elements is formed to be redundant.

17. A display device as claimed in claim 6, wherein the display device comprises means for maintaining the column voltages equal to zero volt while a reset voltage is applied to a row electrode.

18. A display device comprising:

an electro-optical display medium between two parallel opposed support plates having facing surfaces, a system of pixels arranged in rows and columns with each pixel formed by picture electrodes arranged on the facing surfaces of the support plates, a system of row and column electrodes on the support plates for applying drive voltages to the pixels, a common electrode for each row of pixels, a system of first and second series connected asymmetrical non-linear switching elements associated with respective pixels and connected between a respective common electrode and a respective one of the row or column electrodes for the associated pixels and with each pixel connected between a junction of its respective first and second series connected switching elements and the other one of its respective row or column electrode, and a system of capacitive elements associated with respective pixels and connected in parallel with respective first and second series connected asymmetrical non-linear switching elements for storing electric charge for the charge or discharge of its associated pixel.

19. A display device as claimed in claim 18 further comprising:

means for applying a reference voltage to said common electrode whereby said capacitive elements store an electric charge such that their respective pixels can be charged or discharged at the limit of or beyond the voltage range used for picture display.

20. A display device as claimed in claim 19 wherein said reference voltage applying means comprise at least one terminal for connection to a source of reference voltage and coupled to said common electrodes via a system of further asymmetrical switching elements.

21. A display device as claimed in claim 18 wherein the common electrodes comprise first electrodes of the capacitive elements and at least a part of the row or column electrodes comprise second electrodes of the capacitive elements.

22. A display device as claimed in claim 18 wherein the capacitive elements comprise first and second substantially superjacent conductive lines with a dielectric layer interposed therebetween.

23. A display device as claimed in claim 18 further comprising a plurality of non-linear resistance elements connected in parallel with respective ones of said capacitive elements.

* * * * *